United States Patent [19]

Menz

[11] 4,399,764

[45] Aug. 23, 1983

[54] PASSIVE SHOCK MITIGATION SYSTEM WITH SEA WATER METERING SHOCK ABSORBER

[75] Inventor: D. Darrell Menz, Cupertino, Calif.

[73] Assignee: The United States of America as represented by the Secretary of the Navy, Washington, D.C.

[21] Appl. No.: 280,607

[22] Filed: Jul. 6, 1981

[51] Int. Cl.[3] ..... B63B 59/00

[52] U.S. Cl. ..... 114/219; 114/323; 188/288; 267/64.26; 293/1; 405/211

[58] Field of Search ..... 114/219, 323, 312; 188/284, 288, 316; 267/64.26; 405/211, 212; 244/17.17, 161, 100 R; 213/220, 223; 293/1, 102, 107, 134

[56] References Cited

U.S. PATENT DOCUMENTS

| | | | |
|---|---|---|---|
| 1,216,221 | 2/1917 | Erickson et al. | 188/288 |
| 1,679,782 | 8/1928 | Postel . | |
| 1,800,310 | 4/1931 | McGee | 114/323 X |
| 2,681,246 | 6/1954 | Corydon | 293/67 |
| 2,731,289 | 1/1956 | Corydon | 293/67 |
| 2,731,290 | 1/1956 | Corydon | 293/71 |
| 2,997,325 | 8/1961 | Peterson | 293/1 |
| 3,380,557 | 4/1968 | Peterson | 188/1 |
| 3,398,812 | 8/1968 | Peterson | 188/1 |
| 3,489,087 | 1/1970 | Soderberg | 102/2 |
| 3,512,822 | 5/1970 | Rich et al. | 293/1 |
| 3,572,465 | 3/1971 | Olson | 188/1 |
| 3,747,915 | 7/1973 | Hall | 267/139 |
| 3,864,922 | 2/1975 | Dial et al. | 61/48 |
| 3,910,533 | 10/1975 | Cheatham et al. | 244/161 |
| 4,264,236 | 4/1981 | McConnell, Jr. | 405/211 |

*Primary Examiner*—Sherman D. Basinger
*Attorney, Agent, or Firm*—R. S. Sciascia; Charles D. B. Curry; William C. Daubenspeck

[57] ABSTRACT

Passive apparatus for absorbing the kinetic energy of a collision to protect an underwater structure from damage in a collision which includes a ring suspended by a ring support system so that the ring is positioned between the structure and the expected path of potentially impacting objects. The ring support system includes eight rigid rods which have one end coupled to one of four symmetrically disposed supporting pylons by spherical sleeve bushings and their other end coupled by spherical rod ends to one of four standoff members that are fixed to the top surface of the ring at equal intervals around its circumference. A shock absorber is coupled between each supporting pylon and the ring midway between standoff members by spherical rod ends. The dimensions of the rigid rods and their attachment points to the supporting pylon and the ring are chosen so that the ring may pivot on the rods against the resistance of the shock absorbers in response to an impact, but cannot strike the enclosed object. The preferred embodiment employs a shock absorber in which forces are dissipated when two concentric cylinders are compressively displaced to force sea water from an interior chamber formed by the cylinders. As the cylinders are forced together, the sea water is forced out of the chamber through tapered slots in the outside surface of the inner cylinder. As the cylinders are forced together, the size of the orifices provided by the tapered slots is continuously reduced so that progressively greater force is required to eject the sea water from the chamber.

14 Claims, 8 Drawing Figures

PASSIVE SHOCK MITIGATION SYSTEM WITH SEA WATER METERING SHOCK ABSORBER

BACKGROUND OF THE INVENTION

1. Field of the Invention

The present invention relates generally to apparatus for absorbing kinetic energy and, more particularly, to apparatus for protecting circular or spherical structures from damage from collisions. The invention relates especially to passive apparatus for protecting the submarine-mating apparatus of a deep submergence recovery vehicle (DSRV) from damage as a result of a collision with solid objects. The invention further relates to shock absorbers and, especially to a passive sea water metering shock absorber employed in the apparatus for dissipating the collision forces.

2. Description of Prior Art

A primary purpose of the DSRV is to rescue the crew from a distressed submarine. Consequently, the DSRV has a spherical mating skirt which extends downward from the pressure hull of the DSRV (See FIG. 1) and which is intended to mate with the distressed submarine at the submarine's hatch to provide a passage from the submarine to the interior of the DSRV. The mating skirt has an O-ring seal at its mating surface which seals the submarine-mating skirt connection so that the interior of the mating skirt may be dewatered to allow personnel to pass between the submarine and the DSRV. It is most important to protect the mating skirt and, in particular the mating surface from damage as a result of collisions with undetected solid objects or accidental impacts during the mating process to insure that a satisfactory seal may be attained.

In the past, this mating surface has been protected by a shock mitigation system in which a shock mitigation ring is suspended from the lower ends of eight actively-controlled shock absorbers. The upper ends of the shock absorbers are fixed to four pylons which are attached to the outer hull primary structure. The shock absorbers which employ electrically controlled metering valves and fixed orifices to dissipate collision forces, are controlled from the DSRV and use the DSRV's hydraulic and electrical systems. This actively controlled system is not entirely satisfactory.

Primary among the disadvantages are the maintenance and reliability problems associated with the complicated nature of an actively-controlled system. These problems are compounded when the system must be exposed to the corrosive effects of sea water. In addition the complicated, actively-controlled system is very costly to build and maintain.

SUMMARY OF THE INVENTION

It is therefore an object of the present invention to provide apparatus for protecting circular or spherical structures from damage due to collisions with other objects.

Another object of the present invention is to provide self-contained apparatus for protecting submerged structures from damage due to collisions with other objects.

A further object of the present invention to provide a shock mitigation system to protect the mating skirt of the DSRV which does not require active control from the DSRV.

Another object of the present invention is to provide a shock mitigation system of simple construction which presents fewer maintenance and reliability problems.

A further object of the present invention is to provide a self-contained shock mitigation system which does not use petroleum-based hydraulic fluid in shock absorbers, thus eliminating hoses and electrical cables which are potential failure mechanisms.

Another object of the present invention is to provide a passive hydraulic shock absorber which uses sea water as the hydraulic fluid.

A still further object of the present invention is to provide such a sea water shock absorber in which the resistance to compression is progressively greater as the device is compressed.

Still another object of the present invention is to provide such a sea water shock absorber in which the resistance to compression is directly related to the rate of compression.

In the shock mitigation system of the present invention, a shock mitigation ring is suspended by a ring support system, which is of circular geometry and symmetrical with respect to the object being protected, so that the ring is disposed between the object (for example, the submarine mating apparatus of a DSRV) and the expected path of potentially impacting objects. The ring support system includes eight rigid rods which have one end coupled to one of four symmetrically disposed supporting pylons by spherical sleeve bushings and their other end coupled by spherical rod ends to one of four standoff members that are fixed to the top surface of the ring at equal intervals around its circumference. A shock absorber is coupled between each supporting pylon and the ring midway between standoff members by spherical rod ends. The dimensions of the rigid rods and their attachment points to the supporting pylon and the ring are chosen so that the ring may pivot on the rods against the resistance of the shock absorbers in response to an impact, but cannot strike the enclosed object.

The preferred embodiment employs a shock absorber using sea water hydraulics. In the sea water metering shock absorber, forces are dissipated when two concentric cylinders are compressively displaced to force sea water from an interior chamber formed by the cylinders. As the cylinders are forced together, the sea water is forced out of the chamber through tapered slots in the outside surface of the inner cylinder. As the cylinders are forced together, the size of the orifices provided by the tapered slots is continuously reduced so that progressively greater force is required to eject the sea water from the chamber.

Other advantages and features of the invention will become apparent from the following detailed description of the invention when considered in conjunction with the accompanying drawings wherein:

DESCRIPTION OF THE PREFERRED EMBODIMENT

Figure 1:
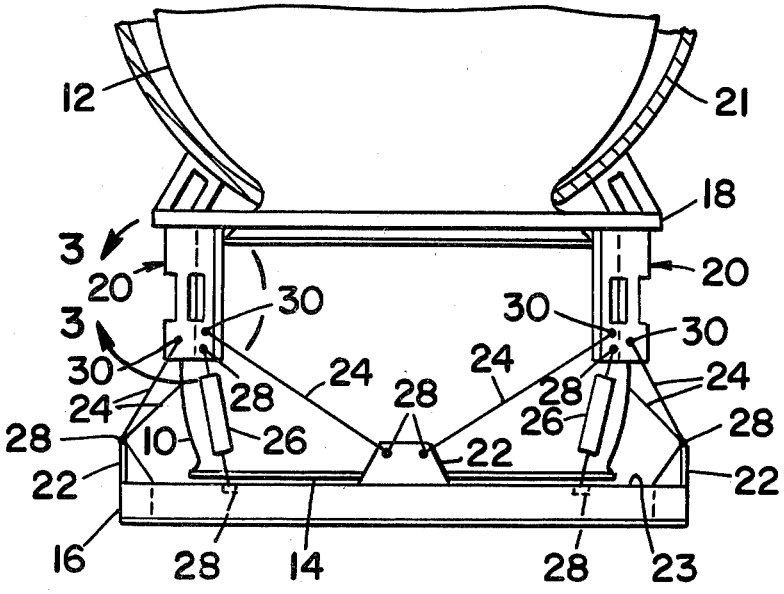
FIG. 1 is an elevation view of the shock mitigation system for protecting the mating apparatus of a DSRV with the tension rods and their couplings illustrated schematically and the outer hull of the DSRV in cross-section.
Figure 2:
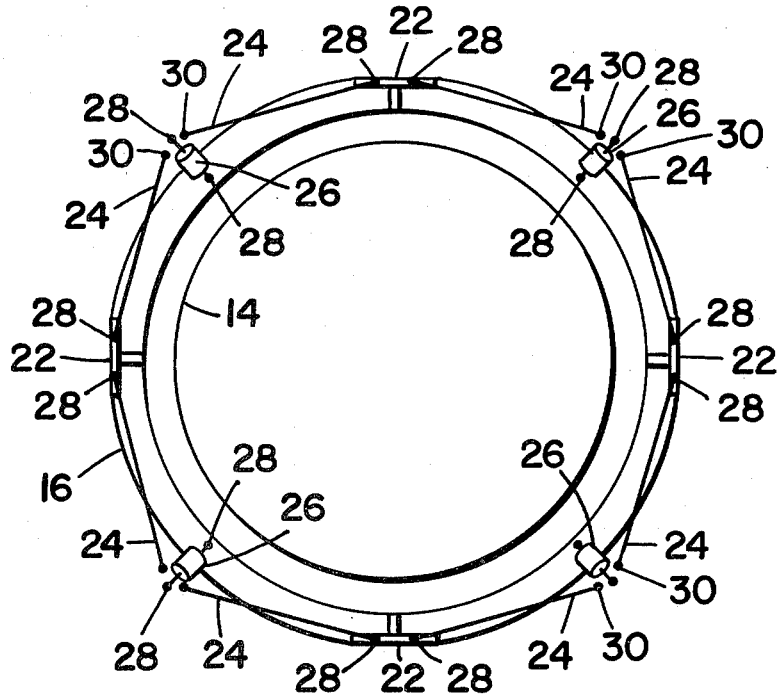
FIG. 2 is a schematic plan view illustrating the ring support system of the present invention.

Referring now to the drawing wherein like reference characters represent like parts in the several views and, in particular to FIGS. 1–4, the mating skirt 10 of circular cross-section extends downward from beneath the pressure hull 12 of the DSRV. As noted earlier, the mating skirt 10 is intended to mate with a distressed submarine (not shown) at the submarine's hatch to provide an escape route from the submarine to the interior of the DSRV. The mating skirt 10 has an O-ring seal 14 at its mating surface which must seal the submarine-mating skirt connection so that the interior of the mating skirt may be dewatered.

The passive shock mitigation system for protecting the mating skirt 10 and the O-ring seal 14 includes a shock mitigation ring 16 which is suspended by a ring support system that allows the ring to move against the resistance of shock absorbers as the result of collision with objects, thereby absorbing the kinetic energy of the impact but preventing the ring itself from striking the mating skirt 10. The ring support system, which is symmetrical with respect to the longitudinal axis of the mating skirt 10, is attached to four rigid supporting legs 20 (pylons) which extend downward from the outer hull structure 21 of the DSRV at equal intervals around the circular geometry of the mating skirt 10. A suitable structure for the pylons will be described in detail hereinafter. Four standoff members 22 are fixed to the outer edge of the top surface 23 of the shock mitigation ring 16 at equal intervals around the ring.

Figure 3:
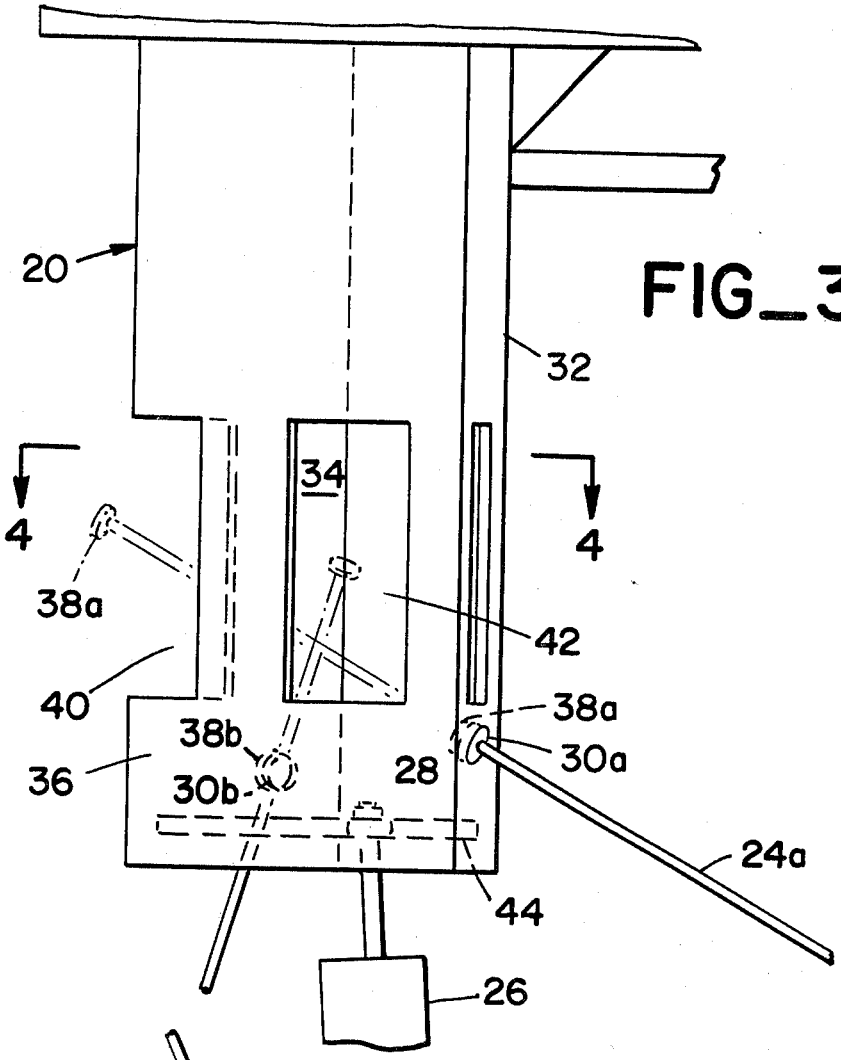
FIG. 3 is an enlarged view of the area identified by line 3—3′ in FIG. 1 more clearly illustrating a pylon and the attachment of the ring support system thereto.
Figure 4:
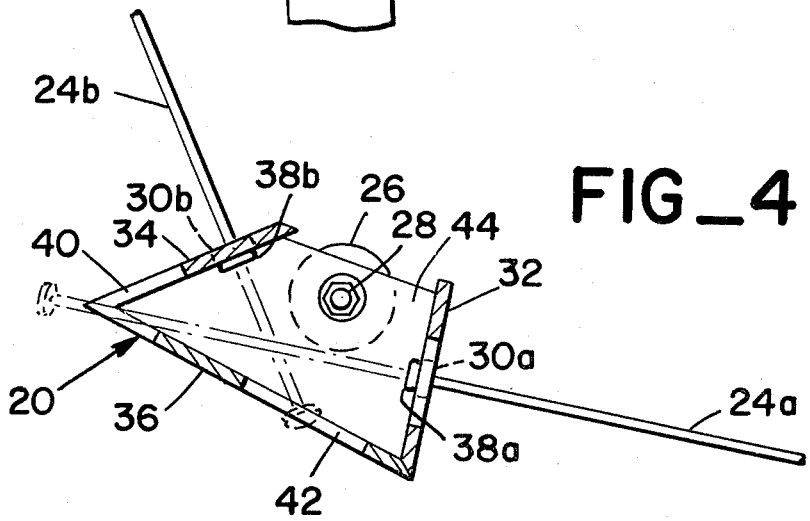
FIG. 4 is a cross-sectional view of the pylon taken along line 4—4' in FIG. 3.
Figure 7:
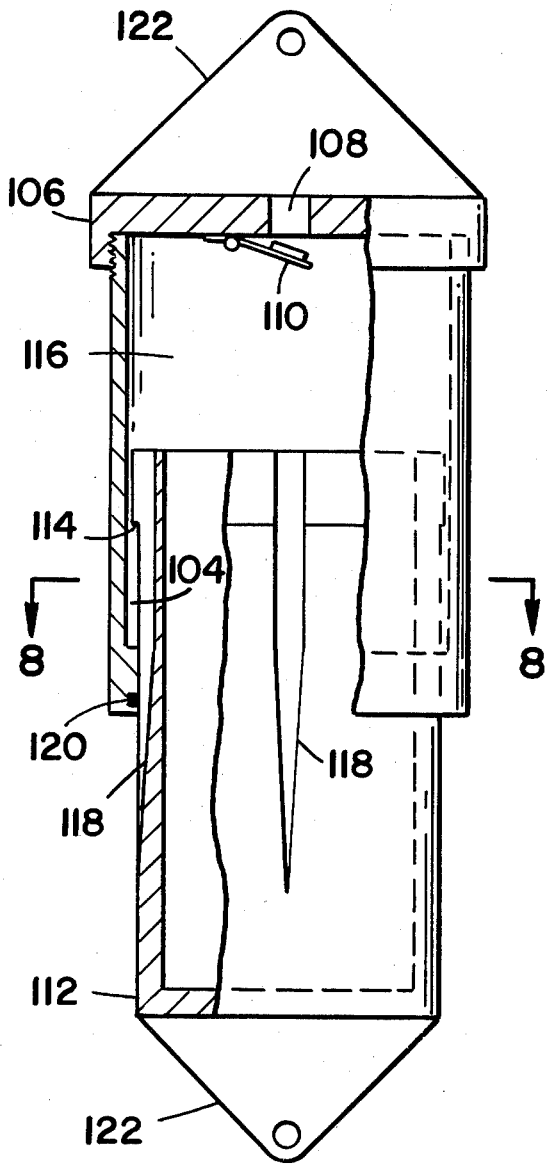
FIG. 7 is a partially cross-sectional, partially broken away view of the sea water metering shock absorber employed in the shock mitigation system.
Figure 8:
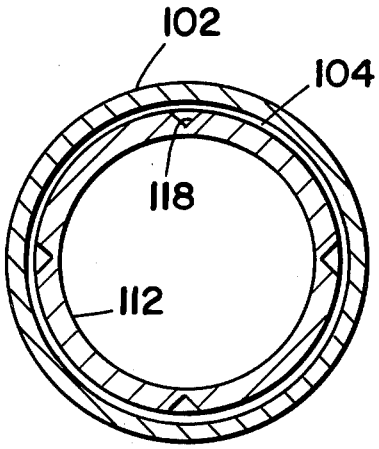
FIG. 8 is a cross-sectional view of the shock absorber of FIG. 7 taken along line 8—8'.

Eight rigid tension rods 24 (shown schematically in FIGS. 1 and 2) are coupled between the four supporting legs 20 and the four standoff members 22 and four water-metering shock absorbers 26 (which will be described in detail hereinafter in connection with FIGS. 7 and 8) are coupled between the supporting legs and the shock mitigation ring 16. Each tension rod 24 has one end coupled to one of the standoff members 22 by a spherical rod end 28 which permits the tension rod to pivot about the attachment point in all directions. The other end of each tension rod 24 is coupled to the lower end of the nearest supporting leg 20 by a spherical sleeve bushing 30 which permits the tension rod to rotate about the attachment point in all directions and also slide through the spherical bushing when the rod experiences compressive forces. As best shown in FIGS. 3 and 4, the tension rods 24 which are attached to the same supporting leg 20 (two tension rods are attached to each supporting leg) are disposed in different planes so that each rod is free to slide through its spherical bushing 30 (under compressive forces) without intersecting the second rod as it slides through the second spherical bushing. Each shock absorber 26 is coupled by spherical rod ends 28 to the shock mitigation ring 16 midway between two of the standoff members 22 and to the nearest supporting leg 20. Each shock absorber is therefore free to rotate about the attachment points.

A suitable pylon structure is shown in the enlarged views of FIGS. 3 and 4. This representative structure includes three vertical plates 32, 34 and 36 with plate 32 oriented to be normal to the horizontal projection of rod **24*a*, plate 34 oriented to be normal to the horizontal projection of rod 24*b* (the projections taken in the at-rest positions of the rods 24*a* and 24*b*) and plate 36 joining the other two plates at the ends opposite the mating skirt 10. The tension rod 24*a* passes through the spherical sleeve bushing 30*a* which is disposed in plate 32. The rod 24*a* has an end cap 38*a* to prevent the rod from passing out of the bushing 30*a* under tension loading. In a similar manner, the tension rod 24*b* passes through the spherical sleeve bushing 30*b* which is disposed in plate 34. An end cap 38*b* prevents the rod from passing out of the bushing 30*b* under tension loading. The pylon structure 20 has windows 40 and 42 which allow the tension rods 24*a* and 24*b***, respectively, to pass through the plane of the plates when they slide in the bushings as a result of experiencing compressive forces.

As represented by the dashed extensions of rods **24*a* and 24*b*, the various moveable elements (rods 24*a* and 24*b*, and the shock absorber 26) are fixed to the pylon structure in a manner to permit their required motions without interfering with each other. It is noted that pylon 20 may take numerous structures different from that described herein as long as the required attachment points and the required freedom of motion are provided for the tension rods and the shock absorbers. A horizontal plate 44 is rigidly fixed to the inner surfaces of the vertical plates 32–36. An end of the shock absorber 26 is fixed to the horizontal plate 44 by the spherical rod end 28**.

The dimensions of the elements of the shock mitigation system are chosen so that (1) it is physically impossible for the shock mitigation ring 16 to strike the mating skirt 10 in response to an impact from any direction and (2) that the ring 16 is suspended in its normal position from the tension rods 24 with its top surface 23 slightly below the bottom of the mating skirt, the position where the ring 16 may be expected to provide the greatest protection from unexpected collisions. The upper pivot points of the tension rods 24 on the supporting pylons 20 and the lower pivot points of the tension rods on the standoff members 22 are chosen so that an impact from any direction will cause the ring 16 to swing on the tension rods; however, the rod or rods experiencing tension forces will prevent the ring from contacting the mating skirt 10.

Figure 5:
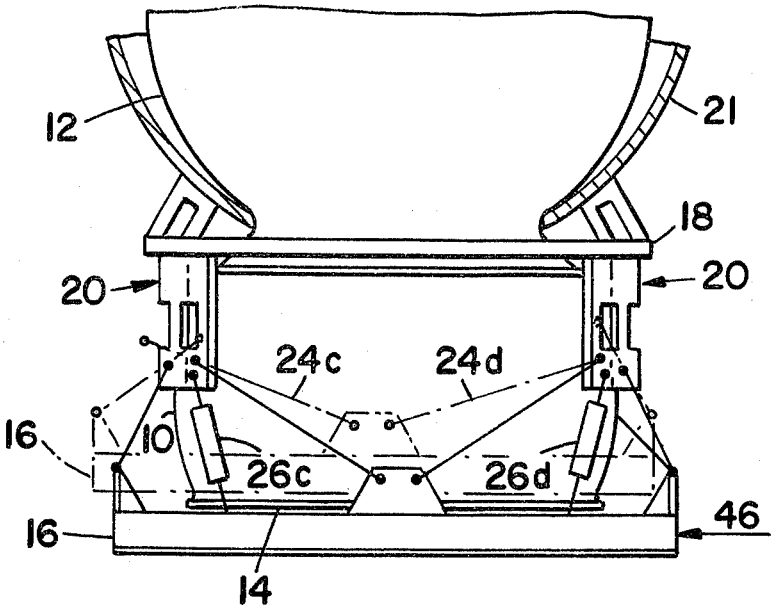
FIG. 5 is an elevation view illustrating the operation of the shock mitigation system in response to an impact on the shock mitigation ring.

For example, an impact at point 46 in FIG. 5, may cause the ring 16 to swing to the position shown by the dashed lines. In this case, the tension rod **24*c* on the left of the Figure will experience compressive forces and the tension rod 24*d* on the right will be placed in tension loading while both rods 24*c* and 24*d* will rotate on the spherical couplings 28 and 30. The compressive force will cause the rod 24*c* to both rotate and slide through the spherical bushing 30*c* to effectively shorten its length, while the tension loading on the rod 24*d* merely causes it to rotate in an arc about its attachment point to the supporting pylon 20**. The other tension rods will operate similarly according to the direction of the component forces that they are experiencing.

Figure 6:
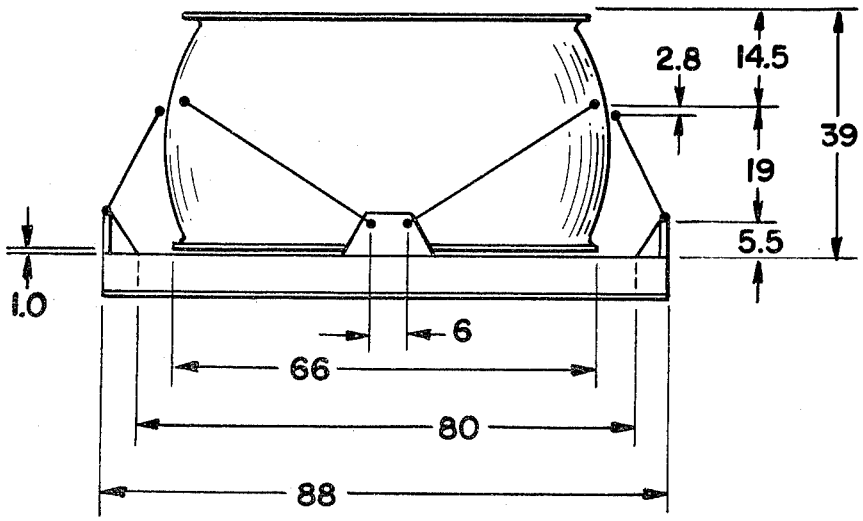
FIG. 6 is an elevation view illustrating representative dimensions of the preferred embodiment for a specific mating skirt.

The shock absorbers 26 which rotate on the spherical rod ends 28 as the ring 16 swings in response to an impact, act to dissipate the kinetic energy of the impact as they experience compressive forces between the supporting pylons 20 and the ring 16. FIG. 6 indicates a representative set of dimensions which will assure that the ring 16 will not be able to strike the mating skirt 10 (of the specific dimensions also noted) because there will always be a rod or rods 16 in tension to limit the motion of the ring.

The sea water metering shock absorber 26 employed in the preferred embodiment is itself of novel structure. Referring now to FIGS. 7 and 8, the sea water metering shock absorber includes an outer cylinder 102 having an annular shoulder 104 at the lower end (upper and lower as used hereinafter refer to the orientation in FIG. 7) of its interior surface. An end cap 106 having a central aperture 108 is threadably secured to the upper end of the outer cylinder 102. A check valve 110 opening into the interior of the cylinder 102 is fixed to the underside of the end cap 106 to control fluid flow through the aperture 108.

An inner cylinder 112 is slidably disposed in the outer cylinder 102. The inner cylinder 112 has an annular shoulder 114 at the upper end of its outer surface which engages the annular shoulder 104 of the outer cylinder 102 when shock absorber 26 is at its maximum extension to prevent the cylinders from being pulled apart. The inner cylinder 112 has an enclosed lower end so that a chamber 116 is formed by the outer cylinder 102, the inner cylinder 112, and the end cap 106.

The outer surface of the inner cylinder 112 has four longitudinal metering slots 118 which are disposed symmetrically around the periphery of the inner cylinder. The metering slots 118 taper outwardly from a maximum cross-sectional area at the upper end of the inner cylinder 112 to merge with the outer surface of the inner cylinder 112 near its lower end. An O-ring seal 120 is disposed in an annular groove in the annular shoulder 104 of the outer cylinder 102 to provide a seal between the inner surface of the outer cylinder 102 and the outer surface of the inner cylinder 112. Couplings 122 are provided at the end cap 106 and the bottom of the inner cylinder 112 for joining the shock absorber 26 to spherical rod ends or other suitable mounting apparatus.

In operation, the variably sized chamber 116 formed by the inner cylinder 102, the outer cylinder 112, and the end cap 106 is filled with sea water which enters through the aperture 108 and the normally open check valve 110. If a compressive force is applied along the longitudinal axis of the shock absorber 26, the inner cylinder 102 and outer cylinder will tend to be forced together. As they are forced together, the increased pressure of the sea water in the chamber 116 will close the normally open check valve 110. When the check valve 110 is closed, the sea water entrapped in the chamber 116 can exit only through the four metering slots 118.

The metering slots 118 provide orifices which vary in cross-sectional area depending on the relative positions of the inner and outer cylinders. When the shock absorber 26 is fully extended, the orifices provided by the metering slots 118 have their maximum cross-sectional area and permit the maximum flow of sea water from the internal chamber 116 as the shock absorbers experience compressive forces. As the inner cylinder 112 and the outer cylinder 102 are forced together, the orifices provided by the tapered slots 118 get progressively smaller. Progressively greater force is required to force the sea water at progressively greater velocities through the progressively reduced orifices. Thus the faster the inner and outer cylinders are forced together the greater the resistance to the motion and, for a given rate of compression, the resistance increases as the cylinders are forced together. When the cylinders are forced together to the point where the orifices disappear (the outer cylinder 102 reaches the end of the metering slot 118), a hydraulic lock is produced so that no additional compression is possible. Thus the sea water metering shock absorber 26 provides a resistance which goes progressively from soft to hard, depending on the relative position of the inner and outer cylinders and upon the rate at which the cylinders are coming together. Any movement of the inner and outer cylinders which increases the size of the internal chamber 116 will reduce the pressure in the chamber, thereby allowing the check valve 110 to open and sea water to again fill the chamber.

It should be noted that the various dimensions of the shock absorber such as the length of the cylinders, the volume of the internal chamber, and the length, taper and number of the tapered slots will be chosen based on the specific characteristics desired.

When the sea water metering shock absorber 28 is operating in the shock mitigation system, the weight of the shock mitigation ring 16 extends the shock absorbers 26 to their maximum expansion (within the limits imposed by the ring suspension apparatus). When ring 16 swings on the tension rods 24 as a result of an impact, the shock absorbers 26 will provide a resistance to the motion of the ring which increases as the shock absorber is compressed and is directly related to the speed of compression, finally resulting in a hydraulic lock to oppose the motion of the ring if the outer cylinder reaches the end of the metering slots.

It is apparent that shock mitigation system of the present invention provides a self-contained, passive system for protecting the mating apparatus of a DSRV. The present invention eliminates the maintenance and reliability problems associated with active systems. There are no hydraulic hoses or electrical cables that are exposed to the corrosive effect of sea water. In particular, the sea water metering shock absorber provides passive apparatus which employs sea water as the hydraulic fluid to provide a variable resistance to dissipate collision forces.

Obviously many modifications and variations of the present invention are possible in the light of the above teachings. It is therefore to be understood that within the scope of the appended claims the invention may be practiced otherwise than as specifically described.

What is claimed is:

1. Passive apparatus for absorbing the kinetic energy of a collision to protect a structure from damage in a collision, which comprises:

(a) a shock mitigation ring for receiving impacts, said ring having an inside diameter large enough for the ring to encircle the structure in the area where the structure is to be protected;

(b) means for suspending said ring such that it is disposed between the area of said structure to be protected and the expected path of potentially impacting objects, said means for suspending comprising:

(1) a plurality of legs for supporting said ring, said legs being fixed relative to the structure and disposed symmetrically with respect to and above the area of the structure to be protected, (2) two rigid rods connected to each of said legs, each of said rods having one end coupled pivotally to one of said legs, each of said rods being slidable through its pivot point in said one of said legs when it undergoes compressive forces, the other end of each of said rods being pivotably coupled to said ring, the length of said rods and the pivoting points relative to the ring and to the legs being chosen so that said ring is suspended between the area of the structure to be protected and the expected path of potentially impacting objects and so that the ring may swing on the pivot points in response to an impact but is prevented from striking the structure to be protected by tension forces on at least one of said rods; and (c) means for resisting the motion of the ring as it swings in response to an impact.

2. Apparatus as recited in claim 1 wherein said means for resisting comprises:

(a) a plurality of shock absorbers, each shock absorber having one end pivotably coupled to one of said legs and the other end pivotably coupled to said ring for dissipating the kinetic energy of the ring as it swings as a result of an impact.

3. Passive apparatus for absorbing the kinetic energy of an underwater collision to protect an underwater structure from damage as a result of said collision, which comprises:

(a) a shock mitigation ring for receiving impacts, said ring having an inside diameter large enough for the ring to encircle the structure in the area where the structure is to be protected;

(b) means for suspending said ring such that it is disposed between the area of said structure to be protected and the expected path of potentially impacting objects, said means for suspending comprising:

(1) a plurality of legs for supporting said ring, said legs being fixed relative to the structure and disposed symmetrically with respect to and above the area of the structure to be protected, (2) two rigid rods connected to each of said legs, each of said rods having one end coupled pivotally to one of said legs, each of said rods being slidable through its pivot point in said one of said legs when it undergoes compressive forces, the other end of each of said rods being pivotably coupled to said ring, the length of said rods and the pivoting points relative to the ring and to the legs being chosen so that said ring is suspended between the area of the structure to be protected and the expected path of potentially impacting objects and so that the ring may swing on the pivot points in response to an impact but is prevented from striking the structure to be protected by tension forces on at least one of said rods; and (c) means for resisting the motion of the ring as it swings in response to an impact.

4. Apparatus as recited in claim 3 wherein said means for resisting comprises:

(a) a plurality of shock absorbers, each shock absorber having one end pivotably coupled to one of said legs and the other end pivotably coupled to said ring for dissipating the kinetic energy of the ring as it swings as a result of an impact.

5. Apparatus as recited in claim 4 wherein each of said shock absorbers comprises:

(a) an inner cylinder having an enclosed end and an open end, said inner cylinder having a plurality of longitudinal tapered slots in its outer surface, said slots being tapered from a maximum cross-sectional area at the open end of said inner cylinder to merge with the outer surface of said inner cylinder;

(b) an outer cylinder concentric with said inner cylinder and having an open end and an enclosed end, said enclosed end having an aperture therein, the open end of said inner cylinder being slidably disposed in the open end of the outer cylinder so that a variably sized chamber is formed by said inner and outer cylinder, the open end of said outer cylinder being adapted to provide a water-tight seal between the inner surface of the outer cylinder and the outer surface of the inner cylinder; and (c) means for closing the aperture in the enclosed end of said outer cylinder when said outer cylinder and said inner cylinder are forced together, the water in the chamber thereby being forced to exit said chamber through the tapered slots to dissipate forces pushing the inner and outer cylinder together.

6. Apparatus as recited in claim 5 wherein said means for closing said aperture includes a one-way check valve which allows water to enter said chamber through said aperture but not exit said chamber through said aperture.

7. Apparatus as recited in claim 6 further comprising means for retaining the open end of said inner cylinder in the open end of said outer cylinder.

8. Apparatus as recited in claim 7 wherein said means for retaining comprises:

(a) an annular shoulder on the outer surface of said inner cylinder at its open end; and (b) an annular shoulder on the inner surface of said outer cylinder at its open end, said annular shoulders engaging to prevent said inner and outer cylinders from being pulled apart.

9. Apparatus as recited in claim 8 wherein said outer cylinder includes sealing means disposed in the inner surface of said outer cylinder to provide a liquid-tight sliding seal between the outer surface of the inner cylinder and the inner surface of the outer cylinder.

10. A passive shock absorber for use submerged in a liquid and using said liquid as hydraulic fluid, which comprises:

(a) an inner cylinder having an enclosed end and an open end, said inner cylinder having a plurality of longitudinal tapered slots in its outer surface, said slots being tapered from a maximum cross-sectional area at the open end of said inner cylinder to merge with the outer surface of said inner cylinder;

(b) an outer cylinder concentric with said inner cylinder and having an open end and an enclosed end, said enclosed end having an aperture therein, the open end of said inner cylinder being slidably disposed in the open end of the outer cylinder so that a variably sized chamber is formed by said inner and outer cylinders, the open end of said outer cylinder being adapted to provide a liquid-tight seal between the inner surface of the outer cylinder and the outer surface of the inner cylinder; and (c) means for closing the aperture in the enclosed end of said outer cylinder when said outer cylinder and said inner cylinder are forced together, the liquid in the chamber thereby being forced to exit said chamber through the tapered slots to dissipate forces pushing the inner and outer cylinder together.

11. A shock absorber as recited in claim 10 wherein said means for closing said aperture includes a one-way check valve which allows liquid to enter said chamber through said aperture but not exit said chamber through said aperture.

12. A shock absorber as recited in claim 11 further comprising means for retaining the open end of said inner cylinder in the open end of said outer cylinder.

13. A shock absorber as recited in claim 12 wherein said means for retaining comprises:

(a) an annular shoulder on the outer surface of said inner cylinder at its open end; and (b) an annular shoulder on the inner surface of said outer cylinder at its open end, said annular shoulders engaging to prevent said inner and outer cylinders from being pulled apart.

14. A shock absorber as recited in claim 13 wherein said outer cylinder includes sealing means disposed in the inner surface of said outer cylinder to provide a liquid-tight sliding seal between the outer surface of the inner cylinder and the inner surface of the outer cylinder.

* * * * *